United States Patent [19]

Maekawa et al.

[11] 4,444,876

[45] Apr. 24, 1984

[54] SILVER HALIDE PHOTOGRAPHIC LIGHT-SENSITIVE MATERIAL

[75] Inventors: Yukio Maekawa, Kanagawa; Tetsuo Takeuchi, Shizuoka, both of Japan

[73] Assignee: Fuji Photo Film Co., Ltd., Kanagawa, Japan

[21] Appl. No.: 401,047

[22] Filed: Jul. 22, 1982

[30] Foreign Application Priority Data

Jul. 22, 1981 [JP] Japan ..... 56-114588

[51] Int. Cl.[3] ..... G03C 1/82

[52] U.S. Cl. ..... 430/528; 430/529; 430/635; 430/636; 430/961

[58] Field of Search ..... 430/528, 529, 635, 636, 430/961

[56] References Cited

U.S. PATENT DOCUMENTS

| | | | |
|---|---|---|---|
| 3,516,835 | 6/1970 | Mackey et al. | 430/531 |
| 3,589,906 | 6/1971 | McDowell | 430/531 |
| 3,843,368 | 10/1974 | Yamamoto et al. | 430/528 |
| 4,304,852 | 12/1981 | Sugimoto et al. | 430/528 |
| 4,347,308 | 8/1982 | Takeuchi et al. | 430/529 |

*Primary Examiner*—J. Travis Brown

*Attorney, Agent, or Firm*—Sughrue, Mion, Zinn, Macpeak and Seas

[57] ABSTRACT

A silver halide photographic light-sensitive material containing an anionic surface active agent which comprises a support having thereon at least one constituting layer containing a compound represented by the following general formula (I):

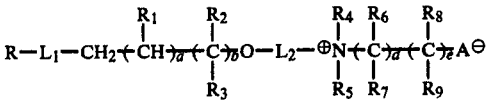

(I)

wherein R represents a saturated or unsaturated hydrocarbon group having from 3 to 20 carbon atoms; $L_1$ and $L_2$ each represents a divalent connecting group; $R_1$, $R_2$, $R_3$, $R_4$, $R_5$, $R_6$, $R_7$, $R_8$ and $R_9$, which may be the same or different, each represents a hydrogen atom, a methyl group, an ethyl group or a propyl group; A represents —COO or —$SO_3$; and a, b, d and e each represents 0, 1 or 2. The silver halide photographic light-sensitive material has an improved antistatic property and can be subjected to development processing using an automatic developing machine without the occurrence of scum, the deposition of water-insoluble substance on transporting rollers and other troubles due to the formation of water-insoluble substance in addition to without the adverse influences on the photographic properties.

18 Claims, No Drawings

SILVER HALIDE PHOTOGRAPHIC LIGHT-SENSITIVE MATERIAL

FIELD OF THE INVENTION

The present invention relates to a silver halide photographic light-sensitive material having an improved antistatic property, and particularly to a silver halide photographic light-sensitive material (hereinafter referred to simply as "photographic light-sensitive material") which has an improved antistatic property and does not result in the formation of scum, the deposition of water-insoluble substance on transporting rollers and other troubles due to the occurrence of water-insoluble substance (for example, unevenness after drying, stain on the film, etc.) when it is subjected to development processing using an automatic developing machine, without exhibiting adverse influences on the photographic properties.

BACKGROUND OF THE INVENTION

Since a photographic light-sensitive material is generally composed of a support having an electric insulating property and photographic layers, electrostatic charges are frequently accumulated by contact friction between or separation from the surfaces of the same or dissimilar materials during the production or use of the photographic light-sensitive material. The electrostatic charges thus accumulated cause various problems. The most serious trouble is that accumulated static charge may discharge before development of the photographic light-sensitive material to cause lightening-like exposure of a light-sensitive emulsion layer, whereby in the development of the photographic film, spot-like, twig-like, or feather-like marks form. These marks are so-called static marks, and occurrence of the static marks greatly reduces the commercial value of the photographic film, or in some cases may result in complete loss of commercial value. For example, in the case of medical or industrial X-ray films, it is easily understood that the static marks may result in a very dangerous judgement or misdiagnosis. This phenomenon is a very troublesome problem, because it becomes clear for the first time by carrying out development. Further, these accumulated static charges cause secondary problems such as adhesion of dust to the surface of films, uneven coating, etc.

Static charges frequently accumulate during the production and use of photographic light-sensitive materials as described above. For example, such charges may be produced by contact friction of a photographic film against rollers during the production of the photographic film, or by separation of the surface of the emulsion layer from the surface of the support during winding or rewinding of the photographic film. Static charges are also produced in a finished photographic film by separation of the emulsion layer surface from the base surface in the case of performing winding or rewinding of a photographic film or in X-ray films by contact, separation, etc., between the X-ray films and mechanical parts or fluorescent intensifying screens in an automatic camera for X-ray films. In addition, they are generated by contact with packing materials, etc.

The occurrence of static marks of photographic light-sensitive materials induced by the accumulation of such static charges becomes more severe as the sensitivity of photographic light-sensitive materials increases and as the processing speed for photographic light-sensitive materials increases. In particular, since the sensitivity of photographic light-sensitive materials has become higher, and there is an increased likelihood that the photographic light-sensitive materials will be treated under severe conditions, such as high-speed coating, high-speed photographing, high-speed automatic development processing, etc., static marks have become increasingly likely to form.

In order to prevent these troubles caused by static charges, it is suitable to add antistatic agents to the photographic light-sensitive materials as described, for example, in U.S. Pat. Nos. 3,850,642, 3,754,924, 3,658,573 and 3,850,640. However, antistatic agents used conventionally in other fields cannot be used freely for photographic light-sensitive materials, because they are subjected to various specific restrictions due to the nature of the photographic light-sensitive materials. Namely, it is required for the antistatic agents capable of use in the photographic light-sensitive materials that not only is the antistatic ability excellent, but also that they do not have adverse influences upon photographic properties of the photographic light-sensitive materials, such as sensitivity, fog, granularity, sharpness, etc., that they do not have an adverse influence upon film strength of the photographic light-sensitive materials (namely, that the photographic light-sensitive materials are not easily injured by friction or scratching), that they do not have an adverse influence upon adhesion resistance (namely, that the photographic light-sensitive materials do not easily adhere when the surfaces of them are brought into contact with each other or with surfaces of other materials), that they do not accelerate deterioration of processing solutions for the photographic light-sensitive materials, and that they do not deteriorate adhesive strength between layers composing the photographic light-sensitive materials, etc. Accordingly, applications of antistatic agents to photographic light-sensitive materials are subject to many restrictions.

One method for overcoming problems caused by static charges comprises increasing electric conductivity of the surface of the photographic light-sensitive material so that static charges disappear within a short time, prior to spark discharging of the accumulated charges, as desribed in the aforementioned U.S. Patents.

Accordingly, processes for improving the electrically conductive property of the base or the surface of various coating layers in the photographic light-sensitive materials have been proposed hitherto. Of these processes, methods of using a surface active agent are utilized and many patents relating thereto are also known since these methods are effective and economical. For example, those described in U.S. Pat. Nos. 2,982,651, 3,454,652, 3,655,387, 3,850,640 and 3,850,641, British Pat. Nos. 1,399,488 and 1,496,534, etc., are known.

However, many of these substances exhibit great specificity, depending upon the kind of film base or the photographic composition, and there are cases that, although they produce a good result on certain specific film bases, photographic emulsions or other photographic elements, they are not only useless for preventing generation of static charges in case of using different film bases and photographic elements, but also have an adverse influence upon photographic properties thereof.

Particularly, static prevention for hydrophilic colloid layers is very difficult, and it frequently happens that the reduction in surface resistance is insufficient in low humidity conditions, and adhesion troubles occur in a photographic light-sensitive material itself or between a photographic light-sensitive material and other dissimilar matters at high temperature and high humidity conditions. Particularly, in light-sensitive materials in which both sides of the base are coated with photographic emulsions, such as medical direct X-ray light-sensitive materials, it has been difficult to develop techniques for effectively providing an antistatic property without having an adverse influence upon photographic properties. Thus, the application of antistatic agents to the photographic light-sensitive materials is very difficult, and their use is often limited to a certain range.

That is, there are many cases wherein, although they have excellent antistatic effects, they cannot be used for photographic light-sensitive materials since they exhibit adverse influences on the photographic properties of silver halide photographic emulsions, such as sensitivity, fog, granularity, sharpness, etc., or they form scum in a fix solution. For example, it is generally known that polyethylene oxide type compounds as described in U.S. Pat. No. 3,850,641 and cationic type compounds as described in U.S. Pat. No. 3,850,640 have a static prevention effect, but they frequently exhibit adverse influences on the photographic properties of silver halide emulsions, such as increasing fog, desensitization, reduction in granularity, etc.

It is also known that betaine type compounds as described in British Pat. No. 1,339,488 have a static prevention effect and they do not exhibit adverse influences on the photographic properties. However, when they are employed in photographic light-sensitive materials containing an anionic type surface active agent, scum is generated during development processing using an automatic developing machine (hereinafter referred to simply as "auto-developing machine"), water-insoluble substance is deposited on transporting rollers of the auto-developing machine (hereinafter referred to simply as "roller stain") and the water-insoluble substance adheres on the surfaces of films (hereinafter referred to simply as "film stain"). Therefore, these compounds have a disadvantage in that the commercial value of the photographic light-sensitive materials is greatly reduced.

SUMMARY OF THE INVENTION

An object of the present invention is to provide a photographic light-sensitive material of an improved antistatic property which contains an anionic surface active agent and is prevented from the generation of the scum, the roller stain and the film stain.

Another object of the present invention is to prevent the occurrence of static charges on a photographic light-sensitive material without exhibiting adverse influences on the photographic properties (sensitivity, fog, granularity, sharpness, etc.).

A further object of the present invention is to provide a photographic light-sensitive material having an improved antistatic property without causing adhesion problems.

These and other objects of the present invention will become more apparent from the following detailed description and examples.

As a result of extensive investigations, it has now been found that these objects can be attained by incorporating a compound represented by the general formula (I) described below into at least one of the constituting layers of a silver halide photographic light-sensitive material containing an anionic surface active agent.

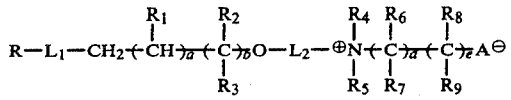

(I)

wherein R represents a saturated or unsaturated hydrocarbon group having from 3 to 20 carbon atoms; $L_1$ and $L_2$ each represents a divalent connecting group; $R_1$, $R_2$, $R_3$, $R_4$, $R_5$, $R_6$, $R_7$, $R_8$ and $R_9$, which may be the same or different, each represents a hydrogen atom, a methyl group, an ethyl group or a propyl group; A represents —COO or —$SO_3$; and a, b, d and e each represents 0, 1 or 2.

DETAILED DESCRIPTION OF THE INVENTION

Examples of the divalent group represented by $L_1$ in the general formula (I) include the following groups:

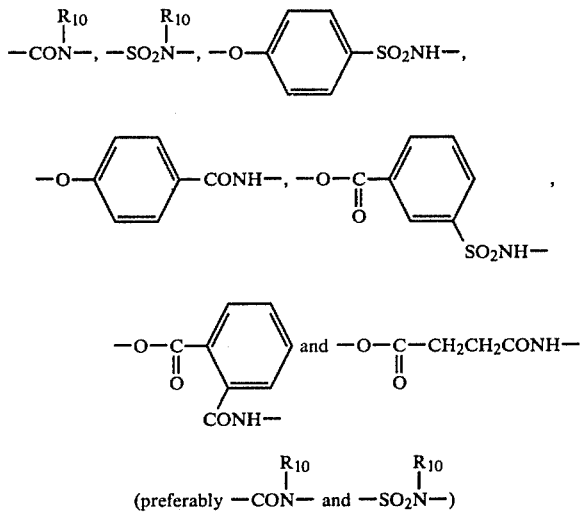

wherein $R_{10}$ represents a hydrogen atom or a saturated or unsaturated hydrocarbon group having from 1 to 12 carbon atoms. For $R_{10}$, a hydrogen atom, a methyl group, an ethyl group and a propyl group are particularly preferred.

Of the groups represented by R, an alkyl group having from 7 to 18 carbon atoms or an alkenyl group having from 7 to 18 carbon atoms are preferred.

While a, b, d and e each represents 0, 1 or 2, it is preferred that both a and b are not 0 at the same time and that both d and e are not 0 at the same time.

Examples of the divalent group represented by $L_2$ include the following groups:

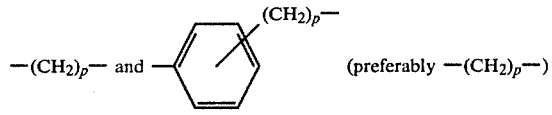

wherein p represents an integer of 1 to 4.

Typical examples of specific compounds which can be used in the present invention are set forth below, but the present invention is not to be construed as being limited thereto.

1.

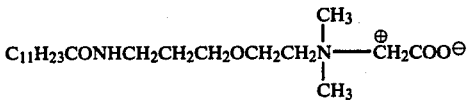

2.

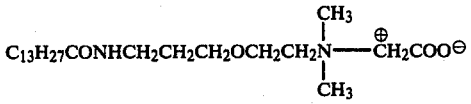

3.

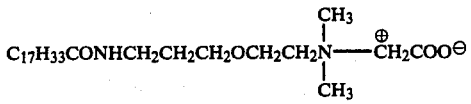

4.

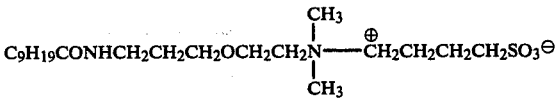

5.

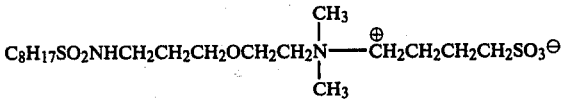

6.

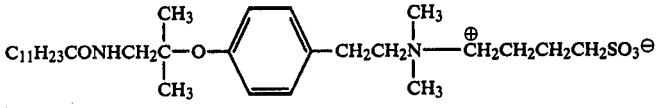

7.

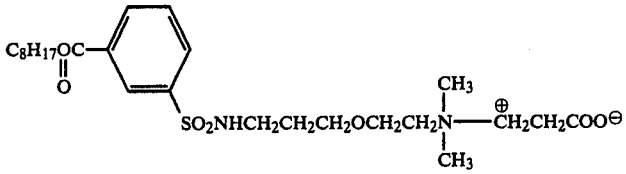

8.

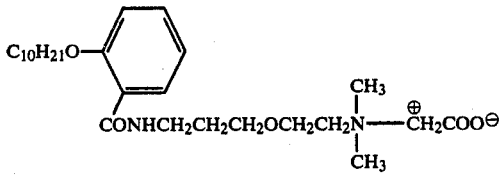

9.

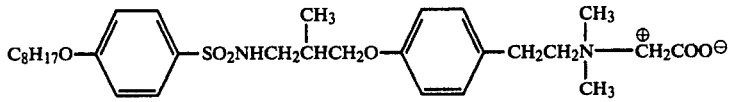

10.

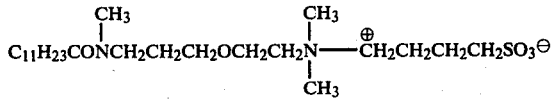

These compounds may be used alone or they may be used as a mixture of two or more compounds.

These compounds can be obtained by a process which comprises reacting alcohol or phenol having a tertiary amino group represented by the general formula (II) described below with nitrile having an unsaturated group represented by the general formula (III) described below or a compound having a nitro group represented by the general formula (IV) described below to form a compound represented by the general formulae (V) or (VI) described below, reducing the nitrile group or the nitro group to convert it into an aminomethyl group or an amino group, and thereafter reacting the resulting compound with a saturated or unsaturated hydrocarbon having a carboxylic or sulfonic acid chloride group

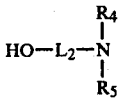

(II)

wherein each of $L_2$, $R_4$ and $R_5$ has the same meaning as defined for formula (I).

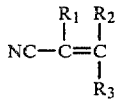

(III)

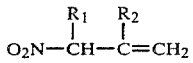

(IV)

wherein each of $R_1$, $R_2$ and $R_3$ has the same meaning as defined for formula (I).

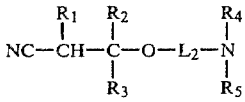

(V)

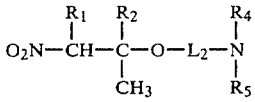

(VI)

wherein each of $R_1$, $R_2$, $R_3$, $R_4$, $R_5$ and $L_2$ has the same meaning as defined for formula (I).

In the following, specific examples of the method for synthesizing the compounds used according to the present invention are described.

SYNTHESIS EXAMPLE 1

Synthesis of Compound 2

Step 1: Synthesis of 2-(3'-myristoylamidopropyl)oxy-N,N-dimethylethylamine 105 g (0.72 mol) of 3-(2'-N,N-dimethylaminoethyloxy)propylamine synthesized from N,N-dimethylethanolamine and acrylonitrile according to the conventional process (for example, F. C. Whitmore et al., *J. Am. Chem. Soc.*, Vol. 66, 725 (1944)) and 250 ml of acetonitrile were placed in a 1-liter three-neck flask equipped with a condenser and kept at 40° C. with stirring. To the mixture, 148 g (0.6 mol) of myristoyl chloride synthesized by a conventional manner was added dropwise over a period of 30 minutes. After conclusion of the addition, the temperature was raised to 60° C. After stirring was continued for 4 hours, a solution composed of 22 g (0.55 mol) of sodium hydroxide and 500 ml of water was added to the mixture. After adding 500 ml of ethyl acetate and stirring, the aqueous layer was separated, and the ethyl acetate layer was washed three times with 250 ml of a 5% aqueous solution of sodium chloride. After separating the aqueous layer, the ethyl acetate layer was dried by adding 50 g of sodium sulfate. After removing the substance which is insoluble to ethyl acetate by filtration, ethyl acetate was distilled off under a reduced pressure to obtain 210 g (yield: 98%) of the above-described compound as an oily product.

Step 2: Synthesis of Compound 2

178 g (0.5 mol) of 2-(3'-myristoylamidopropyl)oxy-N,N-dimethylethylamine obtained in Step 1 above, 47 g (0.5 mol) of monochloroacetic acid and 200 ml of methanol were placed in a 1-liter three-neck flask equipped with a condenser and kept below 30° C. with stirring. To the mixture, 96.5 g (0.5 mol) of a 28% methanol solution of sodium methoxide was added dropwise. After conclusion of the addition, the temperature of the mixture was raised and the mixture was reacted under refluxing for 4 hours with stirring. After removing the insoluble substance by filtration, methanol was distilled off under a reduced pressure and to the residue was added 1 liter of isopropyl alcohol. After removing the insoluble substance by filtration, isopropyl alcohol was distilled off under a reduced pressure. The recrystallization from a solvent mixture of 2 liter of acetone and 2 liter of ethyl acetate was carried out twice to obtain 43 g (yield: 21%) of Compound 2 having a melting point of 62° to 68° C.

SYNTHESIS EXAMPLE 2

Synthesis of Compound 4

Step 1: Synthesis of 2-(3'-decanoylamidopropyl)oxy-N,N-dimethylethylamine 175 g (1.2 mol) of 3-(2'-N,N-dimethylaminoethyloxy)-propylamine and 500 ml of acetonitrile were placed in a 2-liter three-neck flask equipped with a condenser and kept at 40° C. with stirring. To the mixture, 190 g (1 mol) of decanoyl chloride synthesized by a conventional manner was added dropwise over a period of one hour. After conclusion of the addition, the temperature was raised at 60° C. After stirring was continued for 3 hours, a solution composed of 40 g (1 mol) of sodium hydroxide and one liter of water was added to the mixture. After adding 700 ml of ethyl acetate and stirring, the aqueous layer was separated, and the ethyl acetate layer was dried by adding 50 g of sodium sulfate. After removing the substance which is insoluble to ethyl acetate by filtration, ethyl acetate was distilled off under a reduced pressure to obtain 282 g (yield: 94%) of the above-described compound as an oily product.

Step 2: Synthesis of Compound 4

252 g (0.84 mol) of 2-(3'-decanoylamidopropyl)oxy-N,N-dimethylethylamine obtained in Step 1 above, 114 g (0.84 mol) of butanesultone and 300 ml of acetonitrile were placed in a 1-liter three-neck flask equipped with a condenser and the mixture was refluxed with stirring for 10 hours. The mixture was then poured into a 5-liter beaker containing 3 liters of acetone while hot to precipitate crystals. The crystals were collected by filtration and reprecipitation was carried out using 200 ml of ethanol 3 liters of acetone. The crystals were collected by filtration and dried in vacuum to obtain 293 g (yield: 80%) of Compound 4 as white hygroscopic powder. A melting point was 132° to 135° C.

The compound according to the present invention is added to at least one layer of layers constituting the photographic light-sensitive material. Examples of the constituting layers include layers other than a silver halide emulsion layer, for example, a surface protective layer, a back layer, an intermediate layer, or a subbing layer, etc. In the case that the back layer consists of two layers, the compound may be added to any of them. Furthermore, it may be applied as an overcoating on the surface protective layer.

In order to obtain the effect of the present invention most remarkably, it is preferred to add the compound according to the present invention to the surface protective layer, the back layer, or the overcoating layer.

In the case of applying the compound according to the present invention to the photographic light-sensitive material, the compound is dissolved in water, an organic solvent such as methanol, isopropanol, or acetone, etc., or a mixture thereof, and the resulting solution is added to a coating solution for the surface protective layer or the back layer, etc. Then, the coating solution is applied by a dip coating method, an air-knife coating method, or an extrusion coating method using a hopper as described in U.S. Pat. No. 2,681,294, or by a method described in U.S. Pat. Nos. 3,508,947, 2,941,898 and 3,526,528, etc., by which two or more layers are applied at the same time, or the photographic light-sensitive material is dipped in the antistatic solution. Further, if desired, the antistatic solution containing the compound according to the present invention can be additionally applied onto the protective layer.

It is preferred that an amount of the compound according to the present invention be from 0.001 to 2.0 g, and particularly from 0.01 to 0.5 g, per square meter of the photographic light-sensitive material.

However, the above-described amount can vary according to the particular kind of photographic film base to be used, the photographic composition, and the form and method of coating.

An anionic surface active agent can be added alone or as a mixture thereof to the photographic constituting layer of the present invention. It may be used as a coating aid, but it can sometimes be used for other purposes, for example, for emulsification or dispersion, control of triboelectric series, etc.

Some examples of the anionic surface active agents which can be used in the present invention are described in U.S. Pat. Nos. 2,240,476, 2,739,891, 3,026,202, 3,038,804, 3,042,222 and 3,516,835 as well as Ryohei Oda et al., *Kaimen Kasseizai no Gosei to sono Oyo* (*Synthesis and Application of Surface Active Agents*) (published by Maki Shoten Co., 1964), A. W. Perry, *Surface Active Agents* (Interscience Publication Incorporated, 1958), J. P. Sisley, *Encyclopedia of Active Agents*, Vol. 2 (Chemical Publishing Company, 1964), etc.

In the present invention, a fluorine containing surface active agent can also be used together with. Examples of such fluorine containing surface active agents include the following compounds. For example, there are fluorine containing surface active agents as described in British Pat. Nos. 1,330,356 and 1,524,631, U.S. Pat. Nos. 3,666,478 and 3,589,906, Japanese Patent Publication No. 26687/77 and Japanese Patent Application (OPI) Nos. 46733/74 and 32322/76, etc.

Preferred anionic surface active agents suitable for using together with the compound represented by the general formula (I) are those having a sulfonic acid group, a carboxylic acid group, a phosphoric acid group, etc., as an anionic group and a hydrocarbon group, a hydrocarbon group partially or wholly substituted with fluorine atoms, etc., as a hydrophobic portion.

Typical examples of preferred anionic surface active agents which can be used in the present invention are set forth below, but the present invention is not to be construed as being limited thereto.

$$R-\overset{\overset{R_1}{|}}{C}ON-(CH_2)_n-SO_3M \qquad \text{(VII)}$$

wherein R and $R_1$ each represents a hydrocarbon group same as defined in the general formula (I) or that substituted with one or more fluorine atoms; n represents an integer from 1 to 20 and preferably from 1 to 8; and M represents a monovalent alkali metal and preferably sodium or potassium.

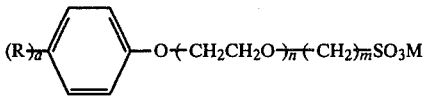
(VIII)

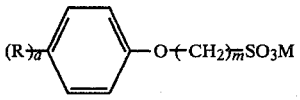
(IX)

In the general formula (VIII) and (IX), R and a each has the same meaning as defined in the general formula (I); n and M each has the same meaning as defined in the general formula (VII); and m represents an integer from 1 to 6 and preferably from 2 to 4.

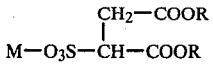
(X)

$$R-O-SO_3M \qquad \text{(XI)}$$

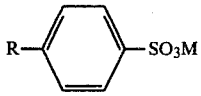
(XII)

In the general formulae (X), (XI) and (XII), R has the same meaning as defined in the general formula (VII); and M has the same meaning as defined in the general formula (VII).

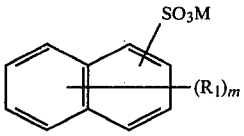
(XIII)

wherein $R_1$ has the same meaning as defined in the general formula (I); M has the same meaning as defined in the general formula (VII); and m has the same meaning as defined in the general formula (VIII).

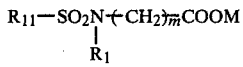
(XIV)

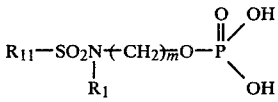
(XV)

In the general formula (XIV) and (XV), $R_{11}$ represents a saturated or unsaturated hydrocarbon group having from 3 to 22 carbon atoms wherein one or more hydrogen atoms are substituted with fluorine atoms, and preferably having from 7 to 18 carbon atoms; $R_1$ has the same meaning as defined in the general formula (I); M has the same meaning as defined in the general formula (VII); and m has the same meaning as defined in the general formula (VIII).

Specific examples of particularly preferred anionic surface active agents used are set forth below, but the present invention is not to be construed as being limited thereto.

A-1 $C_{11}H_{23}CONHCH_2SO_3Na$

A-2 $C_7F_{15}CONH(CH_2)_2SO_3Na$

A-3 $C_8H_{17}CON(CH_2)_2SO_3K$ ($CH_3$)

A-4 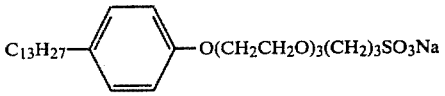

A-5 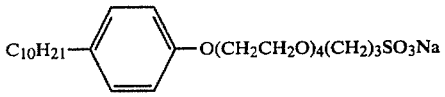

A-6 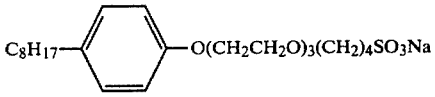

A-7 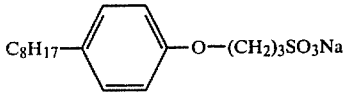

A-8 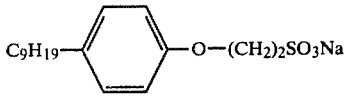

A-9 $NaO_3S-CH(CH_2-COOC_8H_17)-COOC_8H_17$

A-10 $C_7H_{15}-O-SO_3K$

A-11 $C_{12}H_{25}O-SO_3Na$

A-12 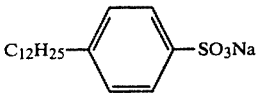

A-13 $C_8F_{17}-SO_2NH(CH_2)_3COONa$

A-14 $C_{17}F_{33}SO_2NH(CH_2)_4COONa$

A-15 $C_{13}F_{27}SO_2NH(CH_2)_3OPO(OH)_2$

A-16 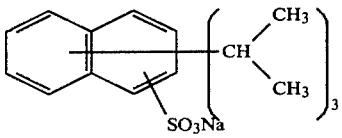

In the present invention, the anionic surface active agent can be employed in any layer constituting the photographic light-sensitive material, for example, a silver halide emulsion layer, an intermediate layer, a surface protective layer, a back layer, etc.

It is preferred that an amount of the anionic surface active agent be from 0.0001 to 1.0 g, and particularly from 0.005 to 0.05 g, per square meter of the photographic light-sensitive material.

Further, it is preferred that a ratio of the anionic surface active agent to the compound represented by the general formula (I) according to the present invention be from 1:0.1 to 1:30, and particularly from 1:0.5 to 1:10 by weight.

Examples of the support used for the photographic light-sensitive material of the present invention include a cellulose nitrate film, a cellulose acetate film, a cellulose acetate butyrate film, a cellulose acetate propionate film, a polystyrene film, a polyethylene terephthalate film, a polycarbonate film and a laminate of them, etc. In more detail, it is possible to use paper coated or laminated with baryta or an $\alpha$-olefin polymer, and particularly a polymer of $\alpha$-olefin having from 2 to 10 carbon atoms such as polyethylene, polypropylene, an ethylene-butene copolymer, etc.

In the photographic light-sensitive material of the present invention, each photographic constituting layers can contain a binder. Examples of useful binders include as hydrophilic colloids proteins such as gelatin, colloidal albumin, casein, etc.; cellulose compounds such as carboxymethyl cellulose, or hydroxyethyl cellulose, etc.; saccharides such as agar, sodium alginate or starch derivatives, etc.; and synthetic hydrophilic colloids, for example, polyvinyl alcohol, poly-N-vinylpyrrolidone, polyacrylic acid copolymer, polyacrylamide, derivatives thereof, partially hydrolyzed products thereof, etc. If desired, these colloids can be used as a mixture of two or more thereof.

Among them, gelatin is the most suitable. The term "gelatin" as used herein means the so-called lime treated gelatin, acid treated gelatin, and enzyme treated gelatin. A part or the whole of the gelatin can be replaced by synthetic polymeric materials. Further, it may be replaced by gelatin derivatives, such as derivatives obtained by treating or modifying amino groups, imino groups, hydroxy groups, or carboxyl groups contained in the gelatin molecule as functional groups with a reagent having a group capable of reacting therewith or graft polymers obtained by bonding thereto the molecular chain of a polymeric material.

A silver halide emulsion used for the photographic light-sensitive material of the present invention is generally produced by blending a solution of a water-soluble silver salt (for example, silver nitrate) with a solution of a water-soluble halide (for example, potassium bromide) in a presence of a solution of a water-soluble high molecular material such as gelatin. As the silver halide, it is possible to use not only silver chloride and silver bromide, but also mixed silver halides such as silver chlorobromide, silver iodobromide, silver chloroiodobromide, etc.

The photographic emulsion can be subjected to a spectral sensitization or supersensitization using polymethine sensitizing dyes such as cyanine, merocyanine, carbocyanine, etc., alone or as a combination thereof, or by using such dyes in combination with styryl dyes, etc.

Furthermore, it is possible to add various compounds to the photographic emulsion for the photographic light-sensitive material used in the present invention in order to prevent deterioration of sensitivity or the occurrence of fog in the step for production of the light-sensitive material, during preservation or during processing. Many such compounds have been known hitherto, examples of which include heterocyclic compounds including 4-hydroxy-6-methyl-1,3,3a,7-tetraazaindene, 3-methylbenzothiazole and 1-phenyl-5-mercaptotetrazole, mercury containing compounds, mercapto compounds, metal salts, etc.

In the case of using the silver halide photographic emulsion as a color photographic light-sensitive material, the silver halide emulsion layer may contain couplers. As such couplers, it is possible to use 4-equivalent diketomethylene yellow couplers, 2-equivalent diketomethylene yellow couplers, 4-equivalent or 2-equivalent pyrazolone magenta couplers or imidazolone magenta couplers, α-naphthol cyan couplers, phenyl cyan couplers, etc.

The silver halide emulsion layer and other layers in the photographic light-sensitive material of the present invention can be hardened by various organic and inorganic hardening agents (alone or as a combination). Examples thereof include aldehyde compounds such as mucochloric acid, formaldehyde, trimethylolmelamine, glyoxal, 2,3-dihydroxy-1,4-dioxane, 2,3-dihydroxy-5-methyl-1,4-dioxane, succinaldehyde, and glutaraldehyde; active vinyl compounds such as divinyl sulfone, methylenebismaleimide, 1,3,5-triacryloylhexahydro-s-triazine, 1,3,5-trivinylsulfonylhexahydro-s-triazine, bis(vinylsulfonylmethyl)ether, 1,3-bis(vinylsulfonylmethyl)propanol-2, and bis(α-vinylsulfonylacetamido)ethane; active halogen compounds such as sodium salt of 2,4-dichloro-6-hydroxy-s-triazine and 2,4-dichloro-6-methoxy-s-triazine; and ethyleneimine compounds such as 2,4,6-triethyleneimino-s-triazine, etc.

Furthermore, the photographic constituting layer in the present invention may contain a lubricating composition such as modified silicone as described, for example, in U.S. Pat. Nos. 3,079,837, 3,080,317, 3,545,970 and 3,294,537 and Japanese Patent Application (OPI) No. 129520/77.

In the photographic light-sensitive material of the present invention, the photographic constituting layer may contain polymer latexes as described in U.S. Pat. Nos. 3,411,911 and 3,411,912, and Japanese Patent Publication No. 5331/70, or silica, strontium sulfate, barium sulfate or polymethyl methacrylate, etc., as a matting agent.

Any of known processes can be applied to photographic processing of the light-sensitive material of the present invention. Therein, known processing solutions can be used. The processing temperature is commonly selected from the range of from 18° C. to 50° C. However, a temperature below 18° C. or above 50° C. may be employed as the processing temperature. Either a development-processing for producing a silver image (black-and-white photographic processing) or a color photographic processing including the development-processing for producing dye images may be applied to the present invention, depending upon the purpose of the end-use of the light-sensitive material.

A developing solution to be employed in the case of black-and-white photographic processing can contain a known developing agent. As such a developing agent, dihydroxybenzenes (e.g., hydroquinone); 3-pyrazolidones (e.g., 1-phenyl-3-pyrazolidone); aminophenols (e.g., N-methyl-p-aminophenol); 1-phenyl-3-pyrazolines; ascorbic acid; such heterocyclic compounds as to be produced by condensing a 1,2,3,4-tetrahydroquinoline ring and an indolene ring, as described in U.S. Pat. No. 4,067,872; and so on can be employed independently or in combination thereof. In addition to the developing agent, a developing solution may generally contain known preservatives, alkali agents, pH buffers and antifoggants, and further it may optionally contain dissolving aids, color toning agents, development accelerators, surface active agents, defoaming agents, water softeners, hardening agents, viscosity providing agents and so on.

As a specific system of the development processing, a method may be used in which a light-sensitive material containing a developing agent, for example, in an emulsion layer is treated with an aqueous alkaline solution to carry out the development. Hydrophobic developing agents can be incorporated into the emulsion layer by a dispersion method using a latex as described in *Research Disclosure,* Vol. 169, No. 16928. Such a development processing may be combined with a silver salt stabilizing process using a thiocyanate.

As a fixing solution, those compositions which have conventionally been used can be used.

As the fixing agent, thiosulfates, thiocyanates, and organic sulfur compounds which have been known to be effective as a fixing agent can be employed.

These fixing solutions may contain water-soluble aluminum salts as a hardening agent.

Conventional methods can be applied to the present invention upon the production of dye images. Namely, the negative-positive method, as described, e.g., in *Journal of the Society of Motion Picture and Television Engineers,* Vol. 61, pages 667 to 701 (1953); the color reversal process, in which, to begin with, a negative silver image is produced through development using a black-and-white developing agent and then overall exposure is undertaken at least once, or another appropriate uniform fogging treatment is carried out and subsequently, color development is effected to produce positive dye image; and silver dye bleach process in which silver image is produced by the development of dye-containing photographic emulsion layers after exposure, and dyes are bleached using the resulting silver image as a bleaching catalyst; and so on can be applied.

Color developing solutions generally comprise alkaline aqueous solutions containing color developing agents. As color developing agents, known aromatic primary amine developing agents, such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.), can be used.

In addition to these color developing agents, those which are described in L. F. A. Mason, *Photographic Processing Chemistry,* pages 226 to 229, Focal Press (1966), U.S. Pat. Nos. 2,193,015 and 2,592,364, Japanese Patent Application (OPI) No. 64933/73, and so forth may be also employed.

The color developing solutions may additionally contain pH buffers such as the sulfites, the carbonates, the borates and the phosphates of alkali metals; development restrainers or antifoggants such as bromides, iodides and organic antifoggants; and so on. Further, water softeners, preservatives such as hydroxylamine, organic solvents such as benzyl alcohol and diethylene glycol, development accelerators such as polyethylene glycol, quaternary ammonium salts and amines, dye forming couplers, competing couplers, fogging agents such as sodium borohydride, auxiliary developers such as 1-phenyl-3-pyrazolidone, viscosity providing agents, chelating agents of polycarboxylic acid series as described in U.S. Pat. No. 4,083,723; antioxidants as described in West German Patent Application (OLS) No. 2,622,950; and so on may be optionally contained in the color developing solutions.

After color development, the photographic emulsion layers are generally subjected to a bleaching processing.

The bleaching processing may be carried out simultaneously with a fixing processing, or it may be carried out individually. Examples of bleaching agents employable in the bleaching processing include compounds of multivalent metals such as Fe(III), Co(III), Cr(VI), Cu(II), etc., peroxy acids, quinones, nitroso compounds and so on. More specifically, ferricyanides, dichromates; organic complex salts of Fe(III) or Co(III), for example, the complex salts of organic acids such as aminopolycarboxylic acids (e.g., ethylenediaminetetraacetic acid, nitrilotriacetic acid, 1,3-diamino-2-propanoltetraacetic acid, etc.), citric acid, tartaric acid, malic acid and so on; persulfates; permanganates; nitrosophenol; and so on can be used. Among these bleaching agents, potassium ferricyanide, sodium ethylenediaminetetraacetatoferrate(III), and ammonium ethylenediaminetetraacetatoferrate(III) are particularly useful. Especially, ethylenediaminetetraacetatoiron(III) complex salts are useful in both an independent bleaching solution and a monobath bleaching and fixing solution.

To a bleaching solution or a combined bleaching and fixing bath, bleaching accelerators as described in U.S. Pat. Nos. 3,042,520 and 3,241,966, Japanese Patent Publication Nos. 8506/70 and 8836/70, and so on; thiol compounds as described in Japanese Patent Application (OPI) No. 65732/78, and other additives can be also added.

The light-sensitive material prepared in accordance with embodiments of the present invention may be processed with the developing solutions which are replenished or controlled so as to maintain their developabilities by such means as described in Japanese Patent Application (OPI) Nos. 84636/76, 119934/77, 46732/78, 9626/79, 19741/79, 37731/79, 1048/81, 1049/81 and 27142/81.

Bleach-fix solutions regenerated by such means as described in Japanese Patent Application (OPI) Nos. 781/71, 49437/73, 18191/73, 145231/75, 18541/76, 19535/76 and 144620/76, and Japanese Patent Publication No. 23178/76 may be applied to the light-sensitive materials prepared in accordance with embodiments of the present invention.

As an auto-developing machine, any of roller transporting type and belt transporting type can be preferably employed.

By the practice of the present invention, the problems due to scum, roller stain and film stain occurring during the development processing of the photographic light-sensitive material containing an anionic surface active agent using an auto-developing machine are remarkably prevented.

Further, by the practice of the present invention, the occurrence of static marks caused by contact between the surface of the emulsion layers and the back surface of the photographic light-sensitive material, contact between surface of the emulsion layer and the surface of the emulsion layer of the photographic light-sensitive material and contact of photographic light-sensitive material with other materials which are frequently brought into contact with the photographic light-sensitive material, for example, rubber, metals, plastics and fluorescent intensifying screens, etc., can also be decreased.

The effects of the present invention will now be illustrated in greater detail by reference to the following example, but the present invention is not to be construed as being limited thereto.

EXAMPLE 1

To one surface of a polyethylene terephthalate film support having a thickness of about 175μ, an emulsion layer and then a protective layer were applied by a conventional method and dried to prepare Samples 1 to 5. The composition of each layer was as follows:

Emulsion Layer: about 5μ:

Binder: Gelatin 2.5 g/m$^2$

Silver content coated: 5 g/m$^2$

Composition of silver halide: AgI 1.5 mol% and AgBr 98.5 mol%

Antifogging agent: 1-Phenyl-5-mercaptotetrazole 0.5 g/Ag 100 g

Protective Layer: about 1μ:

Binder: Gelatin 1.7 g/m$^2$

Coating assistant: Sodium salt of N-oleyl-N-methyltaurine 7 mg/m$^2$

Hardening agent: Sodium salt of 2,4-dichloro-6-hydroxy-1,3,5-triazine 0.4 g/100 g gelatin Sample 1 was composed of only the above-described compositions, and Samples 2 to 4 were composed of the above-described compositions, but additionally the protective layer contained Compounds 1, 2 and 4 according to the present invention in amounts of 20 mg/m$^2$, respectively.

Additionally, for comparison, Sample 5 was prepared wherein 20 mg/m$^2$ of Comparative Compound (A) which is covered by British Pat. No. 1,399,488 was added to the above-described composition to form a protective layer.

Comparative Compound (A)

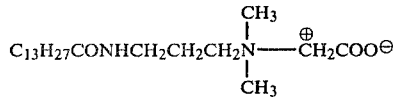

For confirming the occurrence of scum in the cases of processing with a developing solution and fixing solution, about 3 m$^2$ of each of Samples 1 to 5 was processed by a simple auto-developing machine, Fuji X-ray Processor RN (trade name of Fuji Photo Film Co., Ltd. and a volume of each of the developing solution and the fixing solution was 12 liters), and then the formation of scum in the developing solution and the fixing solution, roller stain and film stain were observed visually.

The developing solution and the fixing solution used were the developing solution and the fixing solution for processing medical X-ray film made by Fuji Photo Film Co., Ltd.

| Composition of Developing Solution: | |
|---|---|
| Warm water | 800 ml |
| Sodium tetrapolyphosphate | 2.0 g |
| Anhydrous sodium sulfite | 50 g |
| Hydroquinone | 10 g |
| Sodium carbonate (monohydrate) | 40 g |
| 1-Phenyl-3-pyrazolidone | 0.3 g |
| Potassium bromide | 2.0 g |
| Water to make | 1,000 ml (pH 10.2) |

The results of the scum test are shown in Table 1 below.

TABLE 1

| Sample No. | Occurrence of Scum in Fixing Solution | Occurrence of Scum in Developing Solution | Occurrence of Roller Stain and Film Stain |
|---|---|---|---|
| 1 | None | None | None |
| 2 | " | " | " |
| 3 | " | " | " |
| 4 | " | " | " |
| 5 | Small amount | Large amount | Large amount |

From the results shown in Table 1 above, it is clear that the samples using the compounds according to the present invention did not form scum, roller stain and film stain as compared with the sample using the comparison betaine surface active agent.

EXAMPLE 2

The antistatic property of the samples as described in Example 1 was determined by the following method.

After humidifying the unexposed samples for 2 hours at 25° C. and 25% RH, each of the samples was rubbed by a Neoprene rubber roller on the emulsion layer side of the sample, developed in the same developing solution as in Example 1, fixed, and washed with water, and then the extent of occurrence of static marks was determined.

Then, after exposing the unexposed samples to a tungsten lamp through Filter SP-14 made by Fuji Photo Film Co., Ltd. at an exposure amount of 1.6 CMS (candela meter second), each sample was developed in the same developing solution as in Example 1 for 30 seconds at 35° C., fixed, washed with water, and then the sensitivity and fog were measured. Furthermore, after preserving corresponding unexposed samples for 3 days at 50° C., each of the preserved samples was exposed and processed under the same conditions as above, and then the sensitivity and fog were measured. Thus, the influence of the additives on the photographic properties was determined.

The resulting antistatic and photographic properties of each sample are shown in Table 2 below.

TABLE 2

| Sample No. | Antistatic Agent | Antistatic* Property | Photographic Properties: Directly after Coating Fog | Directly after Coating Sensitivity | After Preservation Fog | After Preservation Sensitivity |
|---|---|---|---|---|---|---|
| 1 | None (Control) | D | 0.16 | 0 | 0.17 | −0.01 |
| 2 | Compound 1 (Present Invention) | A | 0.16 | 0 | 0.16 | 0 |
| 3 | Compound 2 (Present Invention) | A | 0.16 | 0 | 0.16 | 0 |
| 4 | Compound 4 (Present Invention) | A | 0.16 | 0 | 0.16 | 0 |
| 5 | Compound A (Comparison) | A | 0.16 | 0 | 0.17 | 0 |

*Indicates the degree of the occurrence of static marks.

In Table 2 above the extent of the occurrence of static marks was evaluated visually using the following four grades:

A: No static marks formed.
B: Static marks formed a little.
C: Static marks formed considerably.
D: Static marks formed over most of surface.

The sensitivity in Table 2 above was determined by taking the sensitivity of the control sample (Sample No. 1) directly after coating as a standard sensitivity, and the sensitivity of other samples was a deviation from the standard sensitivity shown by the absolute value of log E. No deviation from the standard sensitivity indicates that there was no influence on the photographic property.

From the results shown in Table 2 above, it is understood that the samples containing the antistatic compounds according to the present invention had excellent antistatic effect same as that obtained using the comparative compound, forming almost no static marks, and did not exhibit any adverse influences on the photographic peroperties such as fog, sensitivity, etc.

EXAMPLE 3

After humidifying Samples 1 to 5 as described in Example 1 for 2 days at 40° C. and 70% RH, two sheets (4 cm×4 cm) of each sample were contacted with each other at the surfaces of the protective layers, preserved for 1 day under the conditions of 40° C., 70% RH, while applying thereon a load of 800 g, then the sample sheets were separated from each other, and the area of the stuck portion was measured, evaluated as described below.

| | | |
|---|---|---|
| Rank A: | Area of stuck portion | 0–40% |
| Rank B: | Area of stuck portion | 41–60% |
| Rank C: | Area of stuck portion | 61–80% |
| Rank D: | Area of stuck portion | ≧81% |

The results are shown in Table 3 below.

TABLE 3

| Sample No. | Antistatic Agent | Adhesion Resistance |
|---|---|---|
| 1 | None | C |
| 2 | Compound 1 | A |
| 3 | Compound 2 | A |
| 4 | Compound 4 | A |
| 5 | Comparative Compound A | A |

From the results shown in Table 3 above, it is clear that the samples using the compounds according to the present invention show less adhesion of protective layers with each other and showed good adhesion resistance same as the samples using the comparative compound.

EXAMPLE 4

Samples 6 to 9 each having, on a cellulose triacetate support, in sequence, an antihalation layer, a red-sensitive silver halide emulsion layer, an interlayer, a green-sensitive silver halide emulsion layer, a yellow filter layer, a blue-sensitive silver halide emulsion layer, and a protective layer were prepared by coating and drying according to conventional methods. The compositions of the layers are shown below.

Antihalation Layer:
- Binder: 4.4 g/m$^2$ of gelatin
- Hardening agent: 1,3-bis(vinylsulfonyl)propanol-2 at 1.2 g/100 g of binder
- Coating aid: 4 mg/m$^2$ of sodium dodecylbenzenesulfonate
- Antihalation component: 0.4 g/m$^2$ of black colloidal silver Red-Sensitive Silver Halide Emulsion Layer:
- Binder: 7 g/m$^2$ of gelatin
- Hardening agent: 1,3-bis(vinylsulfonyl)propanol-2 at 1.2 g/100 g of binder Coating aid: 10 mg/m$^2$ of sodium dodecylbenzenesulfonate Silver coverage: 3.1 g/m$^2$ Silver halide composition: 2 mol% AgI and 98 mol% AgBr Antifoggant: 4-hydroxy-6-methyl-1,3,3a,7-tetraazaindene at 0.9 g/100 g of Ag Coupler: 1-hydroxy-4-(2-acetylphenyl)azo-N-[4-(2,4-di-tert-amylphenoxy)butyl]-2-naphthamide at 38 g/100 g of Ag Sensitizing dye: anhydro-5,5'-dichloro-9-ethyl-3,3'-di(3-sulfopropyl)thiacarbocyaninehydroxide.-pyridinium salt at 0.3 g/100 g of Ag Interlayer:

Binder: 2.6 g/m$^2$ of gelatin

Hardening agent: 1,3-bis(vinylsulfonyl)propanol-2 at 1.2 g/100 g of binder

Coating aid: 12 mg/m$^2$ of sodium dodecylbenzenesulfonate

Green-Sensitive Silver Halide Emulsion Layer:

Binder: 6.4 g/m$^2$ of gelatin

Hardening agent: 1,3-bis(vinylsulfonyl)propanol-2 at 1.2 g/100 g of binder

Coating aid: 9 mg/m$^2$ of sodium dodecylbenzenesulfonate

Silver coverage: 2.2 g/m$^2$

Silver halide composition: 3.3 mol% AgI and 96.7 mol% AgBr

Stabilizer: 4-hydroxy-6-methyl-1,3,3a,7-tetraazaindene at 0.6 g/100 g of Ag

Coupler: 1-(2,4,6-trichlorophenyl)-3-[3-(2,4-di-tert-amylphenoxy)acetamido]-4-(4-methoxyphenyl-)azo-5-pyrazolone at 37 g/100 g of Ag Sensitizing dye: anhydro-5,5'-diphenyl-9-ethyl-3,3'-di(2-sulfoethyl)oxacarbocyaninehydroxide.-pyridinium salt at 0.3 g/100 g of Ag Yellow Filter Layer:

Binder: 2.3 g/m$^2$ of gelatin

Filter component: 0.7 g/m$^2$ of yellow colloidal silver

Hardening agent: 1,3-bis(vinylsulfonyl)propanol-2 at 1.2 g/100 g of binder

Surface active agent: 7 mg/m$^2$ of 2-sulfonatosuccinic acid bis(2-ethylhexyl)ester sodium salt Blue-Sensitive Silver Halide Emulsion Layer:

Binder: 7 g/m$^2$ of gelatin

Hardening agent: 1,3-bis(vinylsulfonyl)propanol-2 at 1.2 g/100 g of binder

Coating aid: 8 mg/m$^2$ of sodium dodecylbenzenesulfonate

Silver coverage: 2.2 g/m$^2$

Silver halide composition: 3.3 mol% AgI and 96.7 mol% AgBr

Stabilizer: 4-hydroxy-6-methyl-1,3,3a,7-tetraazaindene at 0.4 g/100 g of Ag

Coupler: 2'-chloro-5'-[2-(2,4-di-tert-amylphenoxy)-butyramido]-α-(5,5'-dimethyl-2,4-dioxo-3-oxazolidinyl)-α-(4-methoxybenzoyl)acetanilide at 45 g/100 g of Ag Protective Layer:

Binder: 2 g/m$^2$ of binder and 0.3 g/m$^2$ of a (1:1) copolymer of styrene-maleic anhydride having a mean molecular weight of about 100,000

Hardening agent: 1,3-bis(vinylsulfonyl)propanol-2 at 1.2 g/100 g of binder

Coating aid: 5 mg/m$^2$ of sodium dioctylsulfosuccinate

Sample 6 had the layers of the above-described compositions only, whereas Samples 7 to 9 further contained 15 mg/m$^2$ of Compounds 2 and 3 according to the present invention, and Comparative Compound A, respectively, in each protective layer.

The antistatic property was determined in the same manner as in Example 2, except that an ordinary color development was performed instead of performing the black-and-white development in Example 1. The results are shown in Table 4 below.

TABLE 4

| Sample No. | Antistatic Agent | Occurrence of Static Mark |
|---|---|---|
| 6 | None (Control) | D |
| 7 | Compound 2 (Present Invention) | A |
| 8 | Compound 3 (Present Invention) | A |
| 9 | Compound A (Comparison) | A |

From the results shown in Table 4 above, it is clear that the samples using the compound according to the present invention formed almost no static marks and showed excellent property.

Further, scum, roller stain and film stain were not observed with Samples 6, 7 and 8. On the contrary, the occurrence of scum, roller stain and film stain was observed with Sample 9.

Color Development Processing

Auto-developing machine: Fujicolor continuous film-processer FNCP-80 (manufactured by Fuji Photo Film Co., Ltd.)

Processing solution: Processing chemicals for Fujicolor negative film CN-16 (manufactured by Fuji Photo Film Co., Ltd.)

Processing conditions:

Temperature: 38° C.

Time:

Development 3 min 15 sec

Bleaching 6 min 30 sec

Fixing 4 min 20 sec

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material containing an anionic surface active agent which comprises a support having thereon at least one constituting layer containing a compound represented by the following general formula (I):

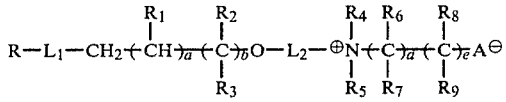

(I)

wherein R represents a saturated or unsaturated hydrocarbon group having from 3 to 20 carbon atoms; $L_1$ represents a divalent connecting group selected from

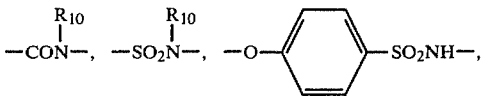

-continued

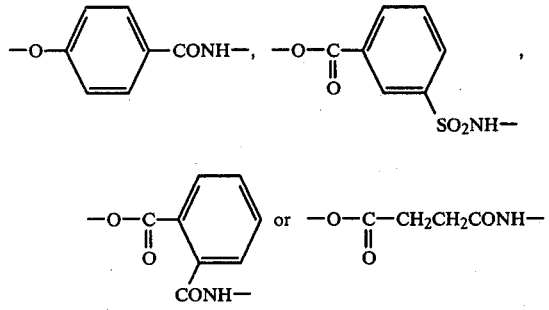

wherein $R_{10}$ represents a hydrogen atom or a saturated or unsaturated hydrocarbon group having from 1 to 12 carbon atoms; $L_2$ represents a divalent connecting group selected from

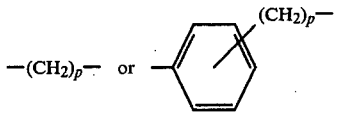

wherein p represents an integer of 1 to 4; $R_1$, $R_2$, $R_3$, $R_4$, $R_5$, $R_6$, $R_7$, $R_8$ and $R_9$, which may be the same or different, each represents a hydrogen atom, a methyl group, an ethyl group or a propyl group; A represents —COO or —$SO_3$; and a, b, d and e each represents 0, 1 or 2.

2. A silver halide photographic light-sensitive material as claimed in claim 1, wherein $R_{10}$ represents a hydrogen atom, a methyl group, an ethyl group or a propyl group.

3. A silver halide photographic light-sensitive material as claimed in claim 1, wherein R represents an alkyl group having from 7 to 18 carbon atoms or an alkenyl group having from 7 to 18 carbon atoms.

4. A silver halide photographic light-sensitive material as claimed in claim 1, wherein both a and b are not 0 at the same time.

5. A silver halide photographic light-sensitive material as claimed in claim 1, wherein both d and c are not 0 at the same time.

6. A silver halide photographic light-sensitive material as claimed in claim 1, wherein the compound represented by formula (I) is present in a layer other than a silver halide emulsion layer.

7. A silver halide photographic light-sensitive material as claimed in claim 1, wherein the compound represented by formula (I) is present in at least one layer selected from a surface protective layer, a back layer, an intermediate layer, and a subbing layer.

8. A silver halide photographic light-sensitive material as claimed in claim 1, wherein the compound represented by formula (I) is present in at least one of a surface protective layer, a back layer and an overcoating layer.

9. A silver halide photographic light-sensitive material as claimed in claim 1, wherein the amount of compound represented by formula (I) is from 0.001 to 2.0 g/m$^2$ of the photographic light-sensitive material.

10. A silver halide photographic light-sensitive material as claimed in claim 1, wherein the amount of compound represented by formula (I) is from 0.01 to 0.5 g/m$^2$ of the photographic light-sensitive material.

11. A silver halide photographic light-sensitive material as claimed in claim 1, wherein the anionic surface active agent is an anionic surface active agent having a sulfonic acid group, a carboxylic acid group or a phosphoric acid group as an anionic group and a hydrocarbon group which may be partially or wholly substituted with fluorine atoms as a hydrophobic group.

12. A silver halide photographic light-sensitive material as claimed in claim 1, wherein the anionic surface active agent is a compound represented by the following formula (VII):

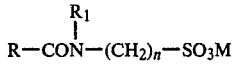

(VII)

wherein R and $R_1$ each represents a hydrocarbon group same as defined in formula (I) or that substituted with one or more fluorine atoms; n represents an integer from 1 to 20; and M represents a monovalent alkali metal.

13. A silver halide photographic light-sensitive material as claimed in claim 1, wherein the anionic surface active agent is a compound represented by the following formula (VIII) or (IX):

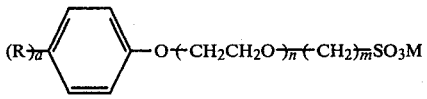

(VIII)

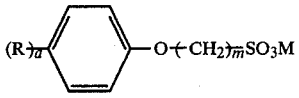

(IX).

wherein R and a each has the same meaning as defined in formula (I); n and M each has the same meaning as defined in formula (VII); and m represents an integer from 1 to 6.

14. A silver halide photographic light-sensitive material as claimed in claim 1, wherein the anionic surface active agent is a compound represented by the following formula (X), (XI) or (XII):

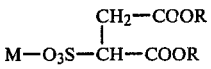

(X)

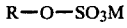

(XI)

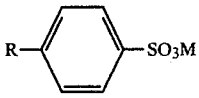

(XII)

wherein R has the same meaning as defined in formula (VII); and M has the same meaning as defined in general formula (VII).

15. A silver halide photographic light-sensitive material as claimed in claim 1, wherein the anionic surface active agent is a compound represented by the following formula (XIII):

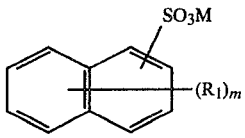

(XIII)

wherein $R_1$ has the same meaning as defined in formula (I); M has the same meaning as defined in formula (VII);

and m has the same meaning as defined in formula (VIII).

16. A silver halide photographic light-sensitive material as claimed in claim 1, wherein the anionic surface active agent is a compound represented by the following formula (XIV) or (XV):

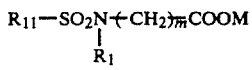

(XIV)

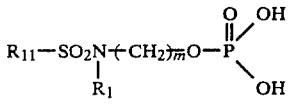

(XV)

wherein $R_{11}$ represents a saturated or unsaturated hydrocarbon group having from 3 to 22 carbon atoms wherein one or more hydrogen atoms are substituted with fluorine atoms; $R_1$ has the same meaning as defined in formula (I); M has the same meaning as defined in formula (VII); and m has the same meaning as defined in formula (VIII).

17. A silver halide photographic light-sensitive material as claimed in claim 1, wherein the amount of the anionic surface active agent is from 0.0001 to 1.0 $g/m^2$ of the photographic light-sensitive material.

18. A silver halide photographic light-sensitive material as claimed in claim 1, wherein the amount of the anionic surface active agent is from 0.005 to 0.05 $g/m^2$ of the photographic light-sensitive material.

* * * * *